United States Patent [19]

Eckert et al.

[11] 4,022,165

[45] May 10, 1977

[54] FUEL INJECTION SYSTEM FOR SUCCESSIVELY INTRODUCING MULTIPLE FUEL QUANTITIES IN AN ENGINE CYLINDER

[75] Inventors: Konrad Eckert, Stuttgart-Bad Canstatt; Josef Steiner, Korb; Klaus Zeilinger, Munich, all of Germany; Helmut Eidtmann, Glen Ellyn, Ill.

[73] Assignee: Robert Bosch G.m.b.H., Stuttgart, Germany

[22] Filed: Nov. 13, 1969

[21] Appl. No.: 876,312

[30] Foreign Application Priority Data

Nov. 13, 1968 Germany ..... 1808650

[52] U.S. Cl. ..... 123/32 G; 123/32 F; 239/533.9

[51] Int. Cl.[2] ..... F02B 3/00

[58] Field of Search ..... 123/32.6, 32.61, 32 SP; 239/533

[56] References Cited

UNITED STATES PATENTS

| | | | |
|---|---|---|---|
| 2,265,692 | 12/1941 | Kammer | 123/32 |
| 2,272,094 | 2/1942 | Murphy | 123/32 |
| 2,315,907 | 4/1943 | Starr | 123/32 SP |
| 2,813,752 | 11/1957 | Pringham | 123/32 |
| 3,014,466 | 12/1961 | Monnut | 123/32 |
| 3,216,407 | 11/1965 | Eyzat | 123/32 |
| 3,339,848 | 9/1967 | Geiger | 239/533 |
| 3,391,871 | 7/1968 | Fleischer | 123/32 |
| 3,394,891 | 7/1968 | Voit | 123/32 |
| 3,477,648 | 11/1969 | Roosa | 239/533 |

FOREIGN PATENTS OR APPLICATIONS

| | | | |
|---|---|---|---|
| 967,693 | 5/1948 | France | 123/32 |
| 650,527 | 1/1929 | France | 123/32 |
| 488,143 | 12/1929 | Germany | 123/32 |
| 701,628 | 1/1941 | Germany | 123/32 |
| 902,334 | 12/1942 | Germany | 123/32 |

OTHER PUBLICATIONS

"Progress in Technology" vol. 11, 1967, Society of American Engineers, pp. 254–290.

*Primary Examiner*—Ronald B. Cox
*Attorney, Agent, or Firm*—Edwin E. Greigg

[57] ABSTRACT

A fuel injection system which is of the type that introduces with a time lag two separate fuel quantities into the same cylinder prior to ignition includes a metering valve assembly to vary one of said quantities supplied by a fuel injection pump and a fuel injection nozzle associated with each engine cylinder and formed of two separate injection valves; one valve is supplied with fuel directly from said fuel injection pump, while the other valve is supplied from said metering valve assembly.

3 Claims, 9 Drawing Figures

INVENTORS
Konrad ECKERT
Helmut EIDTMANN
Josef STEINER
Klaus ZEILINGER
BY
their ATTORNEY INVENTORS
Konrad ECKERT
Helmut EIDTMANN
Josef STEINER
Klaus ZEILINGER
BY
their ATTORNEY INVENTORS
Konrad ECKERT
Helmut EIDTMANN
Josef STEINER
Klaus ZEILINGER
BY
their ATTORNEY INVENTORS
Konrad ECKERT
Helmut EIDTMANN
Josef STEINER
Klaus ZEILINGER
BY
their ATTORNEY INVENTORS
Konrad ECKERT
Helmut EIDTMANN
Josef STEINER
Klaus ZEILINGER
BY
their ATTORNEY

FUEL INJECTION SYSTEM FOR SUCCESSIVELY INTRODUCING MULTIPLE FUEL QUANTITIES IN AN ENGINE CYLINDER

BACKGROUND OF THE INVENTION

This invention relates to a fuel injection system associated with multicylinder internal combustion engines. The system includes a fuel injection pump, from the pump work chamber of which a "main" or "larger" fuel quantity is delivered through a pressure conduit (main conduit) to at least one cylinder of said engine. From said pressure conduit there extends an auxiliary conduit for simultaneously supplying an "ignition" or "smaller" fuel quantity to at least one other cylinder. The two named cylinders operate out of phase due to the angularly offset cranks of the crankshaft.

In fuel injection systems of this type the fuel to be combusted is injected into at least one cylinder in two parts, resulting in a particularly good combustion.

According to a known fuel injection system of the aforenoted type (disclosed, for example, in U.S. Pat. No. 3,216,407), the auxiliary conduit merges into the main conduit of a cylinder operating with a phase shift of half a work cycle. According to another known fuel injection system (as disclosed in German Pat. No. 1,212,782), two main conduits which lead to two cylinders operating at a phase shift of half a work cycle with respect to one another, are interconnected by an auxiliary conduit. In the auxiliary conduits of both of the aforenoted known fuel injection systems, there are disposed throttle devices to ensure that the fuel quantities flowing through the auxiliary conduit are, to a desired extent, smaller than the main fuel quantity.

The fuel injection systems outlined above have the disadvantage that a desired exact distribution of the fuel quantities, either as a constant quantity ratio or as a ratio in which one fuel quantity should remain constant, may not be obtained. The reason is that the fuel passes from one main conduit across an auxiliary conduit branch into another main conduit in which at that moment no fuel is delivered by the fuel pump, so that the liquid column contained in the last-named main conduit yields elastically. Depending upon the rpm-dependent delivery strokes (per time unit) of the fuel injection pump, this elasticity has a stronger or weaker influence, thus variably affecting the ratio of the larger and smaller fuel quantities.

OBJECT AND SUMMARY OF THE INVENTION

It is an object of the invention to provide an improved fuel injection system from which the aforenoted disadvantage is eliminated.

Briefly stated, according to the invention, the successive injections of the larger and smaller fuel quantities into the same cylinder or into the suction tube of that cylinder occur through valves separated from one another. The larger and the smaller fuel quantities, however, may be injected through the same injection opening.

It has been found to be advantageous if the quantity ratio is not constant but, on the contrary, in case the larger quantity increases, the smaller quantity does not increase at all, or increases to a lesser extent. Accordingly, an embodiment of the invention provides that the smaller quantity is determined — in a manner known by itself, as disclosed in German Published Application No. 1,252,002 — by a metering piston which is displaceable against the force of a spring by the pressure of the supplied fuel and which, for defining its position of rest and its maximum stroke, is provided with corresponding abutments.

The invention will be better understood as well as further objects and advantages will become more apparent from the ensuing detailed specification of several exemplary embodiments taken in conjunction with the drawing.

DESCRIPTION OF A FIRST TYPE OF FUEL INJECTION SYSTEM ADAPTED TO INCORPORATE THE INVENTION

Figure 1:
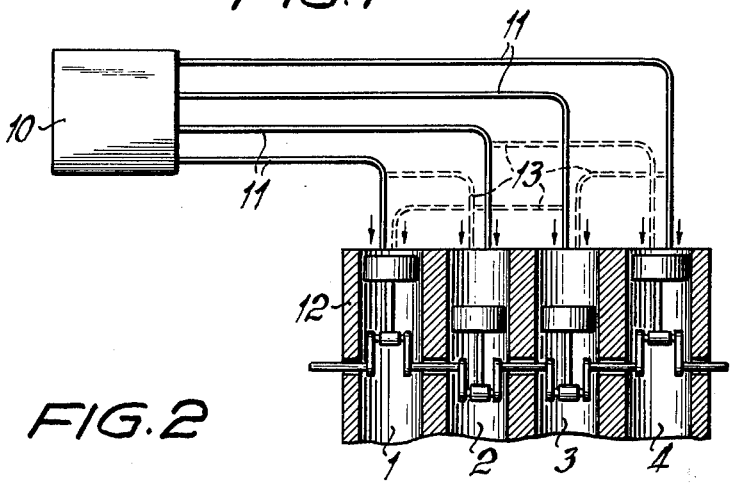
FIG. 1 is a diagrammatic view of a fuel injection system for a four-cylinder engine.
Figure 2:
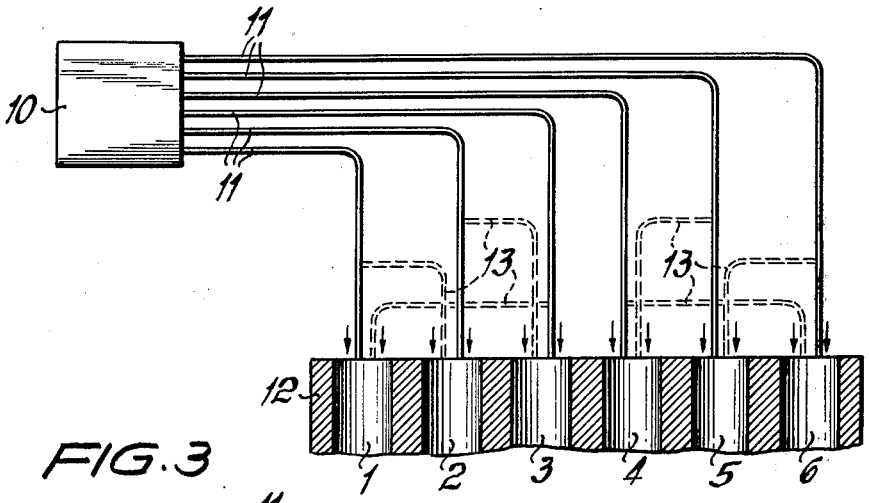
FIG. 2 is a diagrammatic view of a fuel injection system for a six-cylinder engine.
Figure 3:
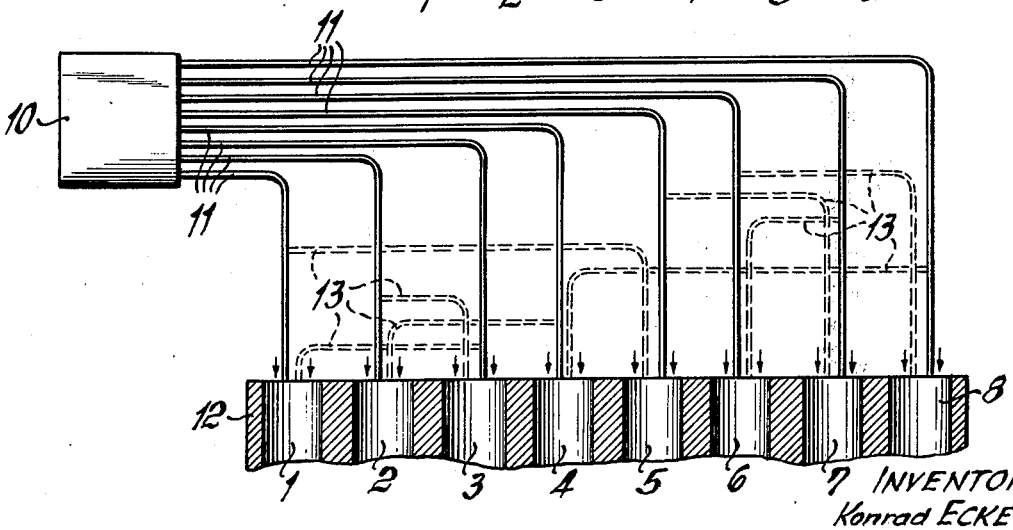
FIG. 3 is a diagrammatic view of a fuel injection system for an eight-cylinder engine.

Turning now to the diagrammatic FIGS. 1–3, in each there is shown a fuel injection pump 10 from which there extends a plurality of pressure or main conduits 11. Each main conduit 11 leads to a different cylinder of a multi-cylinder internal combustion engine 12. From each pressure conduit 11, in the vicinity of the internal combustion engine 12, there extends an auxiliary conduit 13 (each shown in broken lines), leading to a cylinder which, by virtue of an appropriate angular offset of the cranks of crankshaft 14, operates out of phase with respect to the cylinder supplied by the associated main conduit 11.

The fuel injection system illustrated in FIG. 1 is designed for a four-cylinder engine having cylinders 1, 2, 3 and 4. The sequence of ignition, according to the particular angular shift of the cranks of the crankshaft 14, is 1-3-4-2. In each cylinder, first the larger quantity (main quantity) and subsequently the smaller quantity (ignition quantity) is injected. Both quantities, however, have to be injected into the same cylinder during one working cycle thereof. Since the cranks on the crankshaft of this four-cylinder engine are disposed in a single plane, the ignition quantity has to be injected after the crankshaft 14 has turned 180° from the moment of the main fuel quantity injection. Consequently, in such an engine, always those two cylinders are interconnected by means of a conduit unit (i.e. a main conduit and its associated auxiliary conduit) which ignite successively 180° apart. Thus, considering a single conduit unit, first the cylinder associated with the auxiliary conduit 13 ignites, and after 180° of rotation of the crankshaft, the cylinder communicating with the main conduit 11 of the same conduit unit is fired. It is seen that the auxiliary conduits 13 lead from the main conduits 11 associated with cylinders 1, 2, 3 and 4 to the cylinders 2, 4, 1 and 3, respectively.

In the fuel injection system shown in FIG. 2 and designed for a six-cylinder engine, the injection of the smaller quantities follows that of the larger quantities after the crankshaft has turned 240°. The sequence of ignition here is 1 - 5 - 3 - 6 - 2 - 4; the auxiliary conduits 13 lead from the main conduits 11 associated with cylinders 1, 2, 3, 4, 5 and 6 to the cylinders 2, 3, 1, 6, 4 and 5, respectively.

In the fuel injection system according to FIG. 3 and designed for an eight-cylinder engine, the angle through which the crankshaft turns subsequent to the injection of the larger quantities and prior to the injection of the smaller quantities is preferably 270°. In this arrangement, the injection of the larger fuel quantity occurs as early as the beginning of the delivery stroke and the smaller fuel quantity is injected only shortly before the termination of the compression stroke. The auxiliary conduits 13 lead from the main conduits 11 associated with cylinders 1, 2, 3, 4, 5, 6, 7 and 8 to the cylinders 5, 3, 1, 2, 7, 8, 6, 4, respectively.

According to the invention, the larger fuel quantities on the one hand, and the smaller fuel quantities on the other hand, are injected into each engine cylinder through two injection valves separated from one another and forming part of hydraulically entirely separated systems.

DESCRIPTION OF A FIRST EMBODIMENT OF THE INVENTION

Figure 4:
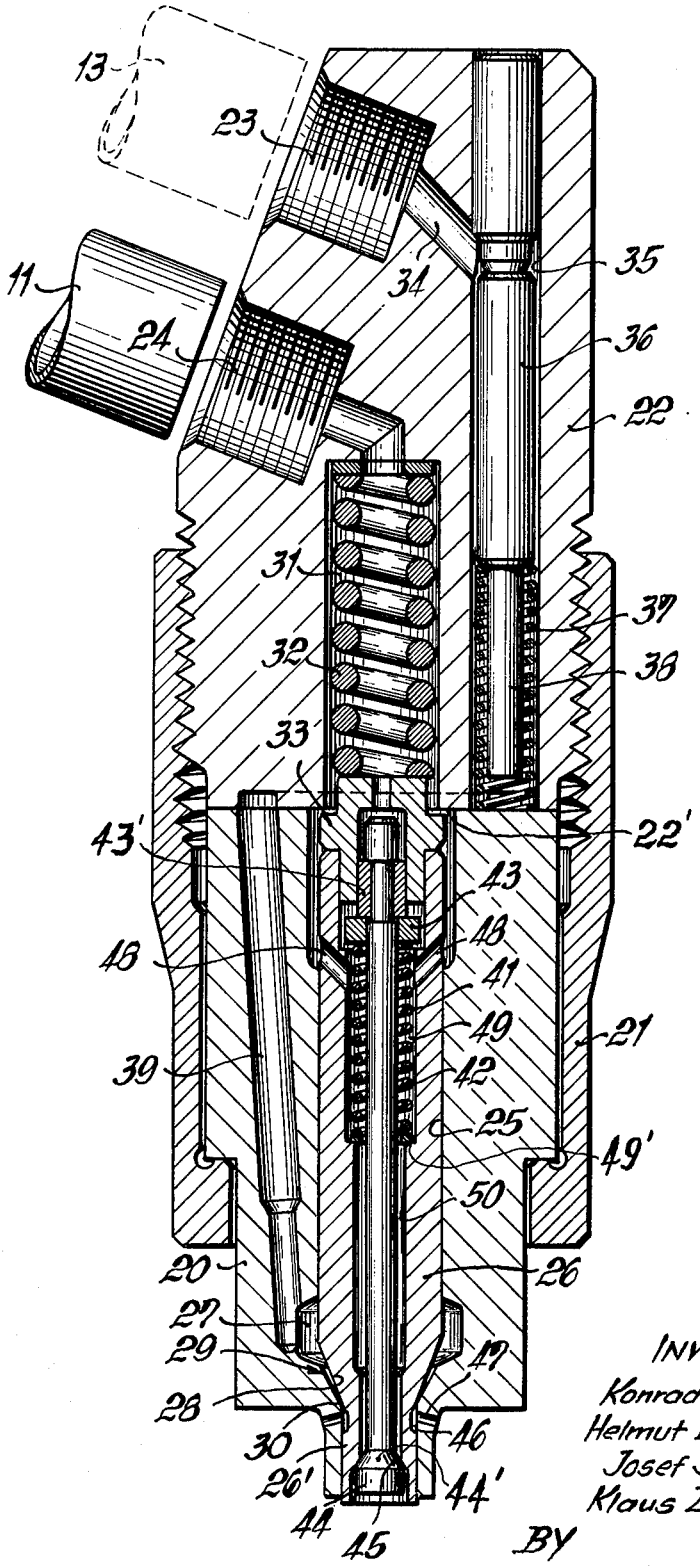
FIG. 4 is an axial sectional view of a fuel injection nozzle including a metering piston.

Turning now to FIG. 4, there is shown a fuel injection valve assembly in a unitary structure particularly adapted to inject the larger and the smaller fuel quantities supplied by systems described hereinbefore in connection with FIGS. 1 – 3.

The fuel injection valve shown in FIG. 4 comprises a nozzle body 20 securely tightened to a nozzle holder 22 by means of a sleeve nut 21. The nozzle holder 22 is provided with coupling bores 23 and 24 for connection with an auxiliary conduit 13 (shown schematically as a broken line) and a main conduit 11 (shown schematically as a solid line), respectively.

In an axial bore 25 of the nozzle body 20 there is disposed, with a snug fit, an axially displaceable hollow valve needle 26, the outer wall of which defines, together with an enlarged wall portion of bore 25, a pressure chamber 27. The hollow needle 26 carries an integral valve cone 28 which cooperates with a valve seat 30 formed of a conical wall portion 29 of nozzle body 1. The nozzle holder 22 is provided with a bore 31 which is in axial alignment with bore 25 and which has a diameter slightly smaller than that of the axial bore 25. The bore 31 is in communication with the coupling bore 24 and accommodates a closing spring 32 which, through a spring seat element 33 inserted in the hollow needle 26, urges the latter against the valve seat 30. The annular shoulder 22′ forming part of the inner terminal face of the nozzle holder 22, serves as an abutment and stroke limiter for the hollow valve needle 26.

From the coupling bore 23 there extends a channel 34 to a bore 35 provided in the nozzle holder 22. In the bore 35 there is disposed, with a loose fit, a metering piston 36 axially displaceable against the force of a return spring 37. The metering piston 36 carries, in axial alignment, an abutment pin or stroke limiter 38. The bore 35 communicates with pressure chamber 27 by means of a channel 39.

In the axial bore 49 of the hollow valve needle 26 there is coaxially disposed another solid valve needle 41 which is displaceable in the direction of the fuel flow against the force of a closing spring 42. One end of the latter engages through a washer a shoulder 49′ provided in the bore 49 of the hollow needle 26. The other end of closing spring 42 engages through a spring seat disc 43 and a sleeve 43′ the valve needle 41 and draws the conical portion 44′ of a valve head 44 integral with valve needle 41 against a conical seat 45 formed in the hollow needle 26.

In order to obtain an entirely separate injection of the larger fuel quantities on the one hand, and the smaller fuel quantities on the other hand, the cone 28 of the hollow needle 26 is joined downstream by annular groove 46 which is in continuous communication with the outlet or nozzle openings 47 provided in the nozzle body 1. The hollow valve needle 26 is guided in a fluid-tight manner by its cylindrical portion 26′ in the nozzle body 20.

The fuel injection valve shown in FIG. 4 operates as part of a fuel injection system of the type shown in FIGS. 1–3 in a manner hereinafter described.

The larger fuel quantity (main quantity) driven by the fuel injection pump 10, flows in the main conduit 11 to the fuel injection valve and passes through the bore 31, bore 25, spring seat element 33, inclined ports 48 provided in the wall of the hollow needle 26 and through bore 49 into an annular pressure chamber 50 formed between the hollow needle 26 and the valve needle 41. As soon as a sufficiently high fuel pressure develops, that is, after the smaller fuel quantity driven through the same conduit system is injected into the cylinder 2 (as will be discussed in more detail hereinafter), the valve needle 41 is displaced so that its head 44 is unseated and, as a result, the main fuel quantity is injected into the cylinder 1. As, subsequently, the smaller fuel quantity is admitted across the channel 34 to the bore 35 over the auxiliary conduit 13 extending from that main conduit 11 which is associated with cylinder 3, a pressure buildup takes place in bore 35. When a sufficiently high fuel pressure is reached in the latter, the metering piston 36 is moved against the force of the return spring 37 until the abutment pin 38 terminates its stroke. The fuel displaced as a result of the movement of the metering piston 36 is forced across the channel 39 into the pressure chamber 27. As a sufficiently large fuel pressure in chamber 27 unseats the hollow needle 26, the smaller fuel quantity is injected into the combustion chamber of the cylinder 1 through the annular groove 46 and the nozzle openings 47.

The effective faces of the valve needle 41 and hollow needle 26 exposed to pressure and operating in the valve opening direction in the pressure chambers 49 and 27, as well as the closing forces of the springs 32 and 42 are designed in such a manner that the solid valve needle 41 of the fuel injection valve associated with cylinder 1 is unseated only at a moment when the hollow valve needle 26 of the fuel injection valve associated with cylinder 2 (i.e. belonging to the same conduit unit 11, 13) is seated after injection of the smaller fuel quantity.

Between two injection steps, the metering piston 36 is returned into its initial starting position by the spring 37 and the space accommodating the spring 37 is again filled with fuel through the annular clearance provided between the metering piston 36 and the bore 35.

DESCRIPTION OF A SECOND TYPE OF FUEL INJECTION SYSTEM ADAPTED TO INCORPORATE THE INVENTION

Figure 5:
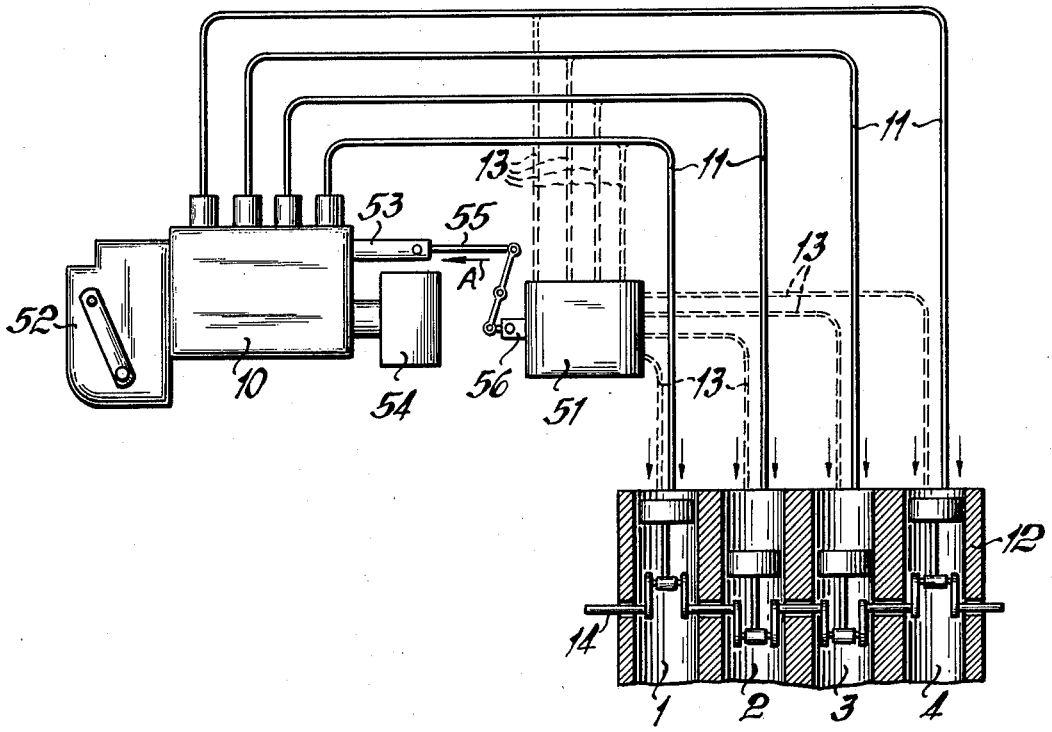
FIG. 5 is a diagrammatic view of a fuel injection system comprising a control apparatus (including a metering piston) and associated with a four-cylinder engine.

In the fuel injection system shown in FIG. 5 and similar to that depicted in FIG. 1, continuity of the auxiliary conduits 13 is broken by the interposition of a common control apparatus 51. The fuel injection pump 10 which in this instance is preferably a serial pump, is associated with an rpm regulator 52, a fuel quantity control rod 53 and a fuel injection timer 54. The fuel quantity control rod 53 is connected with a setting member 56 projecting from the control apparatus 51 by means of a linkage assembly 55.

Figure 6:
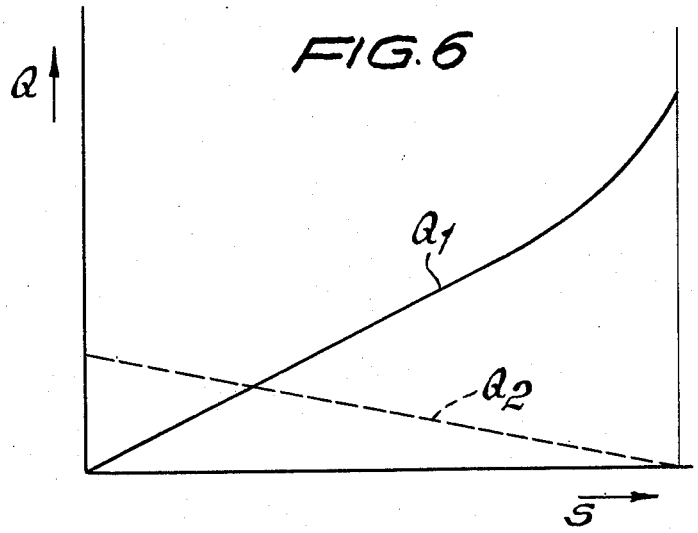
FIG. 6 is a diagram illustrating the change of the ratio of the larger fuel quantity to the smaller fuel quantity effected by a control device of the type schematically shown in FIG. 5.

As shown in the diagram of FIG. 6, the control apparatus 51 which — as will be described later — contains a metering piston comparable to the metering piston 36 according to FIG. 4, is adapted to vary the smaller fuel quantities $Q_2$. In this manner the ratio between the larger and the smaller fuel quantities may be set arbitrarily. In the diagram, the ordinate indicates the injected quantities Q, while the abscissa denotes the travelled distance *s* of the setting member 56. For the purpose of obtaining a well ignitable mixture, particularly combustion engines operating with externally controlled ignition and in which the smaller fuel quantity is injected in the vicinity of the ignition plug, it is desirable to decrease the smaller fuel quantity as the larger fuel quantity increases until, at full load, the smaller or ignition quantity $Q_2$ equals zero. As it is further seen from the diagram of FIG. 6, in case of idling rpms, the main or larger fuel quantity $Q_1$ equals zero whereas the smaller (ignition) quantity $Q_2$ is at its maximum value.

As shown in FIG. 5, during the displacement of the fuel quantity control rod 53 in the full load direction — indicated by the arrow A — the setting member 56 of the control apparatus 51 is — by means of the linkage assembly 55 — displaced in such a manner that the smaller fuel quantity decreases. The displacement of the setting member 56 may be also effected by other means, such as a hydraulic, pneumatic or electric device. In such a case, instead of the fuel quantity control rod 53, the variables affecting the displacement of member 56 may be supplied by the usual sensing elements responsive to the magnitude of engine output.

DESCRIPTION OF A SECOND EMBODIMENT OF THE INVENTION

A second embodiment of the invention comprises the following two structurally separate cooperative components: First, a control apparatus 51 which is a metering valve assembly for controlling the amount of the smaller fuel quantities in each auxiliary conduit 13 and secondly, a two-valve fuel injection nozzle mounted in each cylinder for injecting the larger and the smaller fuel quantities.

Figure 7:
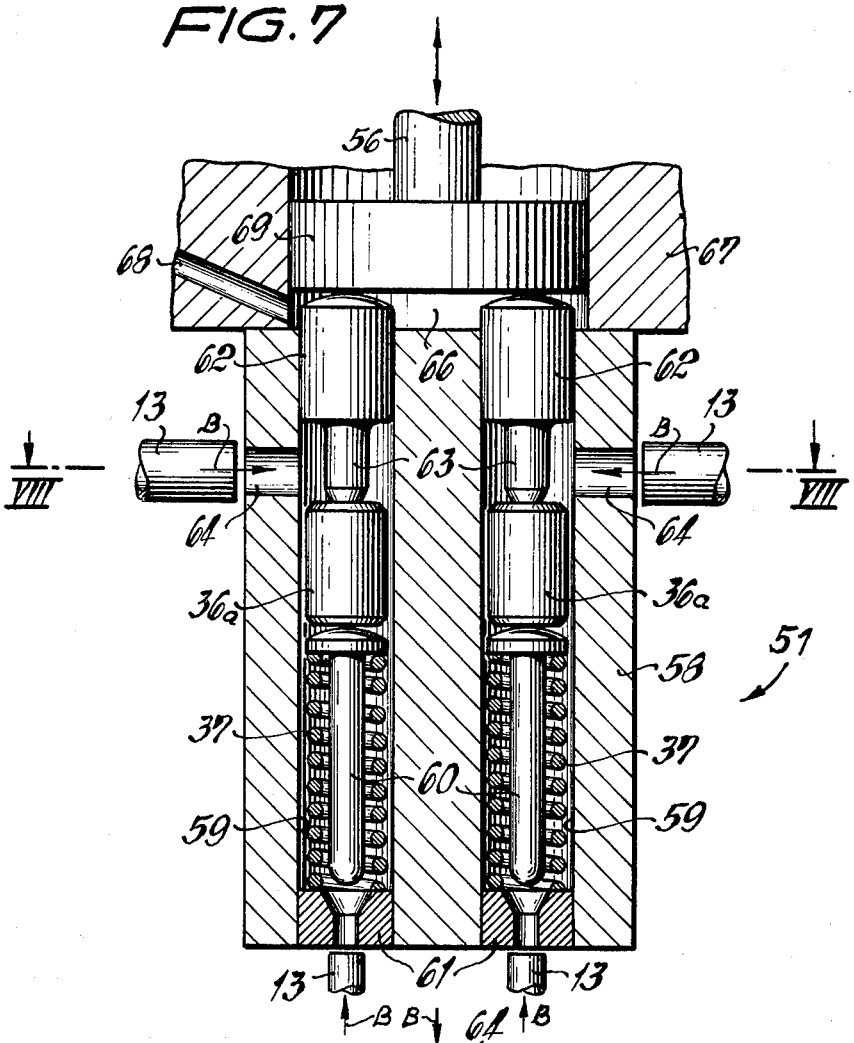
FIG. 7 is an axial sectional view of a control apparatus schematically illustrated in FIG. 5 and taken along line VII—VII of FIG. 8.
Figure 8:
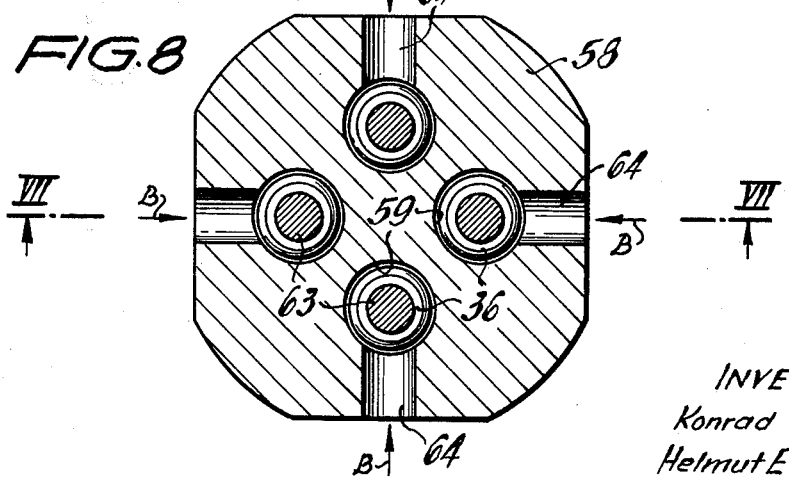
FIG. 8 is a sectional view taken along line VIII—VIII of FIG. 7.
Figure 9:
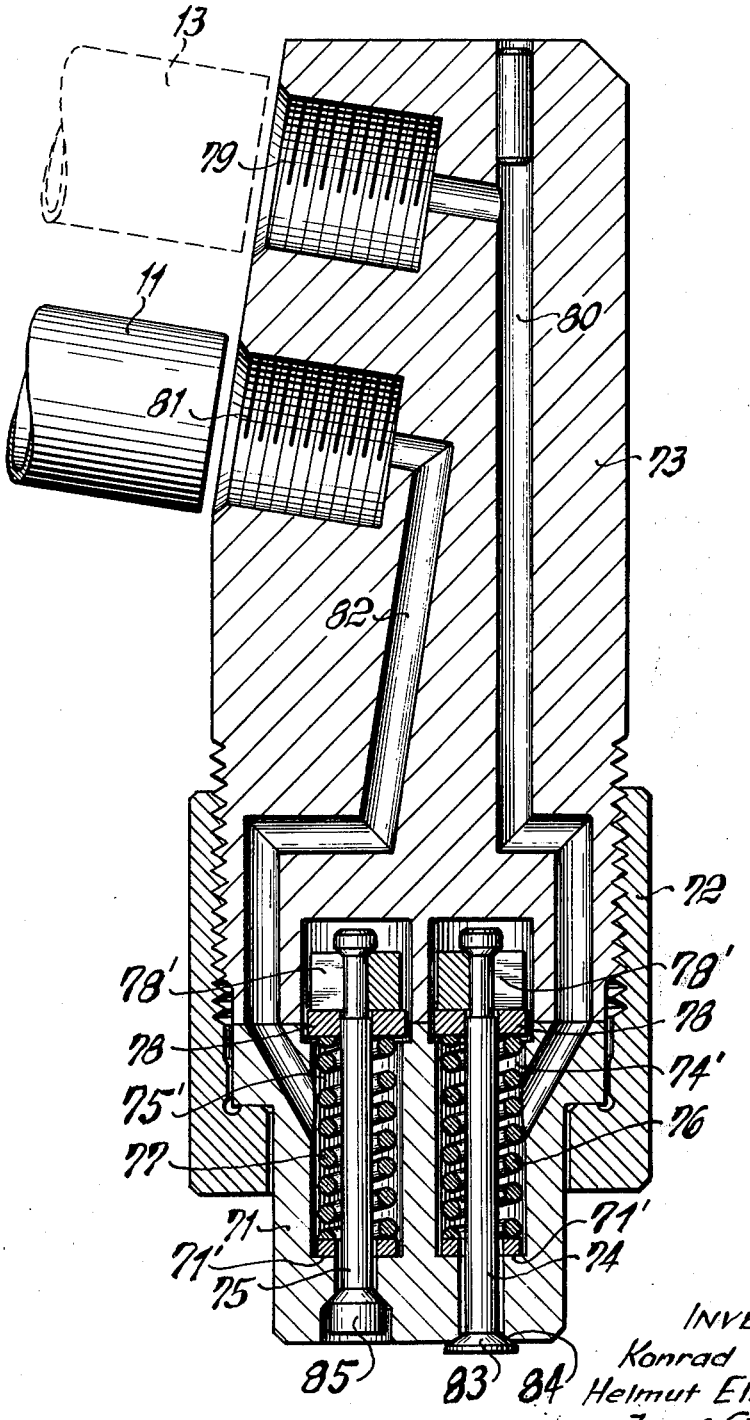
FIG. 9 is an axial sectional view of a fuel injection nozzle adapted to be incorporated in a fuel injection system of the type illustrated in FIG. 5.

The metering valve assembly is shown in FIGS. 7 and 8, while the fuel injection nozzle cooperating therewith is depicted in FIG. 9.

Turning first to FIGS. 7 and 8, the control apparatus schematically indicated at 51 in FIG. 5, comprises a body 58 including four separately arranged axially parallel bores 59, each receiving a metering piston 36*a*. In each bore 59 there is further disposed a valve stem 60 urged into abutting relationship with metering piston 36*a* by a return spring 37. The metering piston 36*a*, when moving downwardly, is adapted to displace the valve stem 60 against the force of return spring 37. The downward stroke of members 36*a*, 60 is terminated when the lower end of the latter engages a valve seat 61 thereby closing the fuel passage. By virtue of the loose fit of the metering piston 36*a* within its bore 59 an annular clearance is obtained through which the space between the metering piston 36*a* and the valve seat 61 may be filled with fuel. This occurs as the spring 37 returns the metering piston 36*a* into its initial position after having forced the fuel from the last-named space towards the injection nozzle to be described later. Upstream of the metering pistons, the bores 59 are connected by means of radial bores 64 with the auxiliary conduits 13 extending from the main conduits 11 as shown in FIG. 5. That portion of the auxiliary conduit 13 that is connected to the associated injection valve (FIG. 9) communicates with the flow passage defined by the valve seat 61. The direction of fuel flow into and out of the metering valve is indicated by arrows B.

The initial position (or position of rest) of the metering pistons 36*a* is determined by abutment pins 62 which are arranged in bores 59 in a fluid-tight manner and are axially displaceable. Adjacent the metering pistons 36*a*, the abutment pins 62 have a pin-like axial extension 63 of substantially reduced diameter, so that the fuel flow from the bores 64 is not obstructed. The abutment pins 62 project beyond the frontal face of the valve body 58 into a chamber 66 provided in a housing head 67 covering the said frontal face of the valve body 58. The buildup of any fluid pressure in chamber 66 is prevented by the provision of a discharge port 68 leading to a leakage channel, not shown. The abutment pins 62 are in engagement with a radial plate 69 rigidly secured to the setting member 56. An axial displacement of setting member 56 and plate 69 shifts the abutment pins 62 whereby the initial position of each metering piston 36*a* is changed prior to the injection of the smaller fuel quantities. Consequently, the stroke of the metering piston 36*a* is also varied, resulting in a change of the smaller fuel quantity supplied to the fuel injection nozzle now to be described.

Turning now to FIG. 9, it is first noted that the metering piston is not disposed within the nozzle structure as in the case of the embodiment described in connection with FIG. 4, but is incorporated — as described precedingly — in the metering valve assembly (FIGS. 7 and 8).

The fuel injection nozzle according to FIG. 9 includes a nozzle body 71 tightened to a nozzle holder 73 by means of a sleeve nut 72. In bores provided in the nozzle body 71 there are disposed valve needles 74 and 75, which are adapted to open in the direction of fuel flow against the force of closing springs 76 and 77, respectively. One end of springs 76 and 77 engages through a washer a shoulder 71′ provided in the bore of nozzle body 71 while the other end of said springs engages a spring seat disc 78 connected to the valve needle by means of a collar 78′. The spaces accommodating springs 76 and 77 also serve as pressure chambers 74′ and 75′, respectively.

The operation of the fuel injection nozzle shown in FIG. 9 will now be described.

For the injection of the smaller fuel quantity, the fuel is admitted from the control apparatus 51 through the auxiliary conduit 13 to a coupling bore 79 provided in the nozzle holder 73. Therefrom, the fuel is admitted through a channel 80 to the pressure chamber 74' of the valve needle 74. For the injection of the main fuel quantity, on the other hand, the fuel is admitted through the main conduit 11 to a coupling bore 81 provided in the nozzle holder 73. Therefrom, the fuel is admitted through a channel 82 to the pressure chamber 75' of the valve needle 75.

The valve head 83 of valve needle 74 and the cooperating valve seat 84 formed in the nozzle body 71 are designed in such a manner that the smaller fuel quantity is injected as a conical stream with a large spray angle; as a result, the smaller fuel quantity is sprayed substantially laterally into a space which is in the immediate vicinity below the spark plug.

On the other hand, the valve head 85 of the valve needle 75 and the cooperating valve seat 86 formed in the nozzle body 71 are designed in such a manner that the larger or main fuel quantity is injected as a conical stream with a small spray angle; as a result, the larger fuel quantity is injected as a relatively straight jet deep into the engine cylinder.

The fuel injection system according to the invention may be particularly advantageously used in externally ignited combustion engines, wherein first the larger fuel quantity is injected into the cylinder and then, after a possibly substantially time lag, the smaller (ignition) fuel quantity is introduced into the same cylinder in the vicinity of the spark plug. The first injected larger fuel quantity thus has sufficient time to vaporize or to mix thoroughly with air, while by means of the subsequently injected smaller fuel quantity, the air-fuel mixture may be rendered ignitable or its ignitability improved.

It is a particular advantage of the fuel injection systems described hereinabove that they are not limited to an injection of fuel directly into the engine cylinders. On the contrary, they may be associated with internal combustion engines wherein the fuel is injected into the suction tube, for example, immediately upstream of the intake valve mounted on the cylinder head. In case of externally ignited combustion engines, the main fuel quantity may be introduced into the suction tube, while the smaller (ignition) fuel quantity may be directly injected into the cylinder in the vicinity of the spark plug.

It is a particular advantage of the invention that the fuel injection system permits an engine operation with excess air. In case of partial load, such excess air improves the total degree of efficiency and decreases the proportion of harmful exhaust gas components. This possibility permits a simplification of the fuel injection system since the butterfly valve and the control apparatus for coordinating the air and fuel quantities may be omitted.

We claim:

1. In a fuel injection system for multicylinder internal combustion engines, said system being of the known type that supplies at least one engine cylinder within one working cycle thereof with a larger or main fuel quantity and with a smaller or ignition fuel quantity, the injection of the two quantities occurring separately in time, said system including (A) a fuel injection pump, (B) at least one main conduit connecting said pump with at least one first engine cylinder to supply the latter with said larger fuel quantity, (C) an auxiliary conduit extending from said main conduit to at least one second engine cylinder for supplying the latter with said smaller fuel quantity simultaneously with supplying said first cylinder with said larger fuel quantity, said first and said second cylinder operating out of phase, the improvement comprising:

a. injection means associated with at least one cylinder;

b. a fuel metering piston associated with each injection means and reciprocably disposed in a bore communicating with an auxiliary conduit carrying said smaller fuel quantity and with a pressure chamber disposed in said injection means;

c. abutment means associated with said fuel metering piston for determining the stroke thereof;

d. a spring in engagement with said fuel metering piston, said fuel metering piston displaceable against the force of said spring by the pressure of fuel admitted from said fuel injection pump, said fuel metering piston determining the amount of said smaller fuel quantity; and e. a control apparatus containing a plurality of said bores in a parallel arrangement and an abutment means engageable by each fuel metering piston for determining the position of rest thereof, said abutment means is displaceable with respect to said fuel metering pistons to vary the stroke thereof for changing the amount of said smaller fuel quantity.

2. An improvement as defined in claim 1, wherein said abutment means engageable by each fuel metering piston for determining the position of rest thereof includes A. an abutment pin disposed reciprocably in each bore in a fluid-tight manner and engageable by the fuel metering piston in said bore, B. a sole plate member engageable by all of said abutment pins, and C. means for arbitrarily displacing said sole plate member in the direction of reciprocation of said fuel metering pistons to vary the stroke thereof.

3. In a fuel injection system for multicylinder internal combustion engines, said system being of the known type that supplies at least one engine cylinder within one working cycle thereof with a larger or main fuel quantity and with a smaller or ignition fuel quantity, the injection of the two quantities occurring separately in time, said system including (A) a fuel injection pump, (B) at least one main conduit connecting said pump with at least one first engine cylinder to supply the latter with said larger fuel quantity, (C) an auxiliary conduit extending from said main conduit to at least one second engine cylinder for supplying the latter with said smaller fuel quantity simultaneously with supplying said first cylinder with said larger fuel quantity, said first and said second cylinder operating out of phase, the improvement comprising injection means associated with at least one cylinder, said injection means having a first fuel injection valve for introducing said larger fuel quantity, a second fuel injection valve for introducing said smaller fuel quantity, said first and second fuel injection valves being hydraulically permanently separated from one another, a first coupling means forming part of said first fuel injection valve and receiving a terminus of a main conduit carrying said larger fuel quantity and a second coupling means forming part of said second fuel injection valve and receiving a terminus of an auxiliary conduit carrying said smaller fuel quantity, wherein:

i. said fuel injection means includes:

a. a nozzle body, b. a first and a second valve needle disposed in said nozzle body and cooperating with associated valve seats and forming therewith said first and second fuel injection valves, respectively, each valve needle includes face portions exposed to fuel pressure exerting an opening force on said valve needle, c. a return spring associated with each valve needle and urging the latter into a closed position against its valve seat;

d. a first and a second pressure chamber disposed in said nozzle body and communicating with said first and second valve needle, respectively; said first pressure chamber and first valve needle are hydraulically entirely separated from said second pressure chamber and said second valve needle; and ii. one of said valve needles is hollow and the other of said valve needles is coaxially disposed within said hollow valve needle, with the valve seat associated with the last-named valve needle being formed in said hollow valve needle and with the valve seat associated with the latter being formed in said nozzle body.

* * * * *